United States Patent [19]

Perrin

[11] 3,960,122

[45] June 1, 1976

[54] ENGINE EXHAUST BRAKE FOR OTTO-ENGINES OPERATED WITH GAS

[75] Inventor: Günter Perrin, Stuttgart, Germany

[73] Assignee: Daimler-Benz Aktiengesellschaft, Germany

[22] Filed: Mar. 29, 1974

[21] Appl. No.: 456,292

[30] Foreign Application Priority Data

Mar. 30, 1973 Germany ..... 2315947

[52] U.S. Cl. ..... 123/97 B; 123/120

[51] Int. Cl.[2] ..... F02D 31/00; F02D 35/02

[58] Field of Search ..... 123/97 B, 107, 120; 188/273

[56] References Cited

UNITED STATES PATENTS

| | | | |
|---|---|---|---|
| 2,767,697 | 10/1956 | Udale | 123/97 B |
| 2,805,656 | 9/1957 | Williams | 123/97 B |
| 2,947,392 | 8/1960 | Heine | 123/97 B X |
| 3,042,153 | 7/1962 | Alfieri | 188/273 |
| 3,053,242 | 9/1962 | Arpaia | 123/97 B X |
| 3,199,498 | 8/1965 | Scholtyssek | 123/97 B |
| 3,254,743 | 6/1966 | Finger | 123/97 B X |
| 3,256,870 | 6/1966 | Walker | 123/97 B |
| 3,525,317 | 8/1970 | Muir | 123/97 B |

*Primary Examiner*—Charles J. Myhre
*Assistant Examiner*—William C. Anderson
*Attorney, Agent, or Firm*—Craig & Antonelli

[57] ABSTRACT

An engine exhaust brake for a motor vehicle operated with an Otto-engine, which upon its engagement causes the closing of the exhaust gas line by means of a throttle device and the opening of the throttle valve controlling the mixture supply; a gas-air mixer is thereby arranged upstream of the throttle valve whose gas supply is controlled by the output stage of a membrane-controlled gas-regulator whose vented side is connected with the atmosphere by way of an air line and preferably also by way of a filter protection; a control valve is also arranged in the air line which is controlled by the engine-brake engaging mechanism and which upon engagement of the engine brake connects the vented side of the output stage of the gas regulator with the engine suction pipe, whose vacuum causes the closing of the gas supply to the gas-air mixer.

19 Claims, 1 Drawing Figure

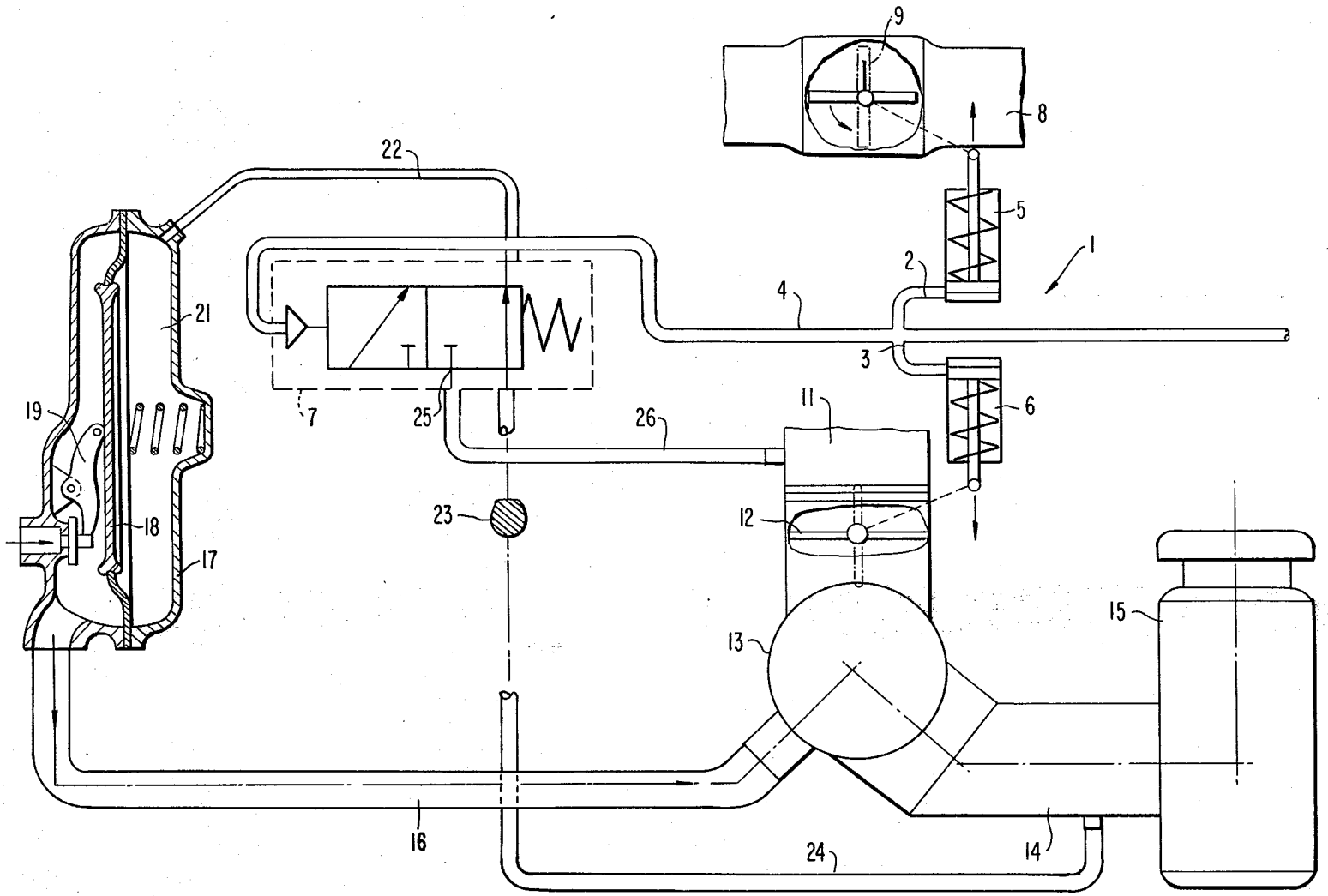
1
2
3
4
5
6
7
8
9
11
12
13
14
15
16
17
18
19
21
22
23
24
25
26

ENGINE EXHAUST BRAKE FOR OTTO-ENGINES OPERATED WITH GAS

The present invention relates to an engine exhaust brake for a motor vehicle operated with a gas engine, which upon its engagement causes the closing of the exhaust gas line by means of a throttle device and the opening of the throttle valve regulating the mixture supply, upstream of which is arranged a gas-air mixer whose gas supply is controlled by the output stage of a diaphragm-controlled gas regulator, whose vented side is connected with the atmosphere by way of an air line, and preferably also by way of a filter protection.

For heavy commercial vehicles such as trucks and buses, in addition to the normal operating brake and the hand brake, a third brake independent of these brakes is prescribed by law in Germany.

This third independent brake is, for the most part, an engine exhaust brake in commercial vehicles which cooperates with the Diesel engines customarily used with the commercial types of vehicles. In such an engine exhaust brake, the air previously compressed in the engine is throttled by a throttle valve at the end of the exhaust elbow and thus the drag power of the engine is increased which acts by way of the drive as brake output on the driven wheels.

In contradistinction to the Diesel engine, for the most part, expensive eddy current vortex brakes, so-called retarders, were used heretofore for gas Otto-engines or with official approval, a third brake had to be dispensed with which was otherwise legally required in connection with heavy vehicles.

The present invention is therefore concerned in particular with the application of the engine exhaust brake in gas engines operating according to the Otto-combustion process and with the particular construction of the means necessary for engaging the brake, i.e., for rendering the brake operative.

In order to be able to attain as high a drag output of the engine as possible, a large quantity of air has to be sucked-in by the engine, has to be compressed and has to be throttled at the exhaust brake valve. In the Diesel engine with mixture control, this air quantity is determined only by the control periods and by the suction cross sections whereas in an engine with filling control, the air quantity is additionally determined by the suction throttle valve. This throttle valve which follows the gas-air mixer in the flow direction of the gas-air mixture, has to be opened during the closing of the brake valve. These measures can be realized by a mechanically, pneumatically or hydraulically actuated actuating member which opens the suction throttle valve as soon as the exhaust brake is actuated and the exhaust brake valve is closed.

In the Otto-engines with mixture formations in the gas-air mixer, however, the arrangement is such that with an open suction throttle valve, fuel is supplied in the largest possible quantities as required normally at full load. Consequently, during the engagement of the exhaust engine brake, care must be taken that with an opened suction throttle valve during the engagement of the engine brake, the gas supply is interrupted. This is customarily achieved in that the gas supply is interrupted between the gas regulator or governor of the gas system and the gas-air mixer by a separate and very expensive valve because this valve has to be suitable for combustion gases and additionally has to have a large cross section corresponding to the low pressure gas line.

In order to avoid such large and expensive valves which are also prone to failures by their actuation, a small control valve is provided according to the present invention which does not have to correspond to the high requirements for gases, which is arranged in the air line connected to the output stage of the membrane-controlled gas regulator and which is controllable by the engaging mechanism of the engine brake and which upon the engagement of the engine brake, connects the vented side of the output stage of the gas regulator with the engine suction pipe whose vacuum causes the closing of the gas supply to the gas-air mixer. For the actuation of the small valve according to the present invention, the second stage of the gas-regulator is therefore utilized as cut-off device for the gas in that the regulator diaphragm is acted upon by the suction pipe vacuum. During the actuation of the engine exhaust brake, the connection of the regulator diaphragm with the atmospheric air or with the pure air side of the air filter is then interrupted and the corresponding side of the regulator diaphragm is connected to the suction pipe of the engine and is thereby acted upon by the vacuum. This vacuum causes the closing of the throttle valve arranged in the output stage of the gas regulator.

With an engine exhaust brake controlled according to the present invention, according to a further feature of the present invention, the filter protection of the air line can be formed by the usual air filter arranged upstream of the gas-air mixer whereby appropriately the air line is then connected to the air intake connecting the air filter with the gas-air mixer. On the other hand, the filter protection of the air line may be constituted exclusively by a dust-protection sieve which is mounted on the end of the air line disposed in proximity of the valve.

In the engine exhaust brake according to the present invention, the valve as well as the throttle valve and the exhaust brake valve, as to the rest, may be controlled mechanically, hydraulically or pneumatically by any conventional means. For that purpose, one, two or three mechanical, hydraulic or pneumatic actuating members may be provided which simultaneously actuate the valve, the throttle valve and the exhaust brake valve in unison, in combination of two's or each by itself.

Accordingly, it is an object of the present invention to provide an engine exhaust brake for Otto-engines operated with gas which avoids by simple means the aforementioned shortcomings and drawbacks encountered in the prior art.

Another object of the present invention resides in an engine exhaust brake for Otto-engines which eliminates the need for expensive retarders, yet assures an operationally reliable and simple arrangement of the brake system.

A further object of the present invention resides in an engine exhaust brake which permits the attainment of a drag output of the engine that is as high as possible, yet is relatively simple in construction and obviates the need for large and expensive structural parts.

Still another object of the present invention resides in an engine exhaust brake of the type described above which eliminates large parts that are prone to operational failures as a result of their actuation.

These and further objects, features and advantages of the present invention will become more apparent from the following description when taken in connection with the accompanying drawing which shows, for purposes of illustration only, one embodiment in accordance with the present invention, and wherein:

The single FIGURE is a schematic view of an engine exhaust brake in accordance with the present invention.

The means required for the actuation of an engine exhaust brake according to the present invention and their connections are illustrated in the single FIGURE of the drawing, from which their cooperation will become apparent and by reference to which such cooperation will be explained more fully hereinafter.

Referring now to the single FIGURE of the drawing, an actuating member generally designated by reference numeral 1 and of any conventional construction is schematically illustrated in this FIGURE, which is operatively connected by way of the lines 2, 3, and 4 with two shifting valves 5 and 6 as well as with the valve 7 according to the present invention.

In case of a mechanically operating actuating member, the lines 2, 3, and 4 may be replaced by analogous, mechanically operating linkages of conventional type.

The shifting valve 5 is so connected with the exhaust brake valve 9 disposed in the exhaust 8 of the engine (not shown) that the exhaust brake valve 9 is closed upon the engagement of the engine exhaust brake whereas it is opened during the normal operation of the vehicle. In contradistinction thereto, the shifting valve 6 is so connected with the suction throttle valve 12 disposed in the suction pipe 11 that this throttle valve 12 is opened during the actuation of the engine exhaust brake independently of its customary actuation in connection with the gas lever or gas pedal.

A gas-air mixer 13 of conventional construction is connected to the suction pipe 11 upstream of the throttle valve 12 in the suction pipe 11, as viewed in the flow direction of the gas-air mixture. On the one hand, air is supplied to the gas-air mixer 13 through the air intake 14 by way of the air filter 15 and, on the other, combustion gas is supplied to the gas-air mixer 13 through the gas line 16.

The quantity of the respectively required gas is controlled by the gas governor or regulator of any conventional construction and therefore not shown in detail whose output stage 17 only is illustrated in the drawing. A diaphragm or membrane 18 and a flap or control valve 19 controlled by the diaphragm 18 are disposed in this output stage 17. Customarily, the vented side 21 of the diaphragm or membrane 18 is connected with the atmosphere by way of an air line 22, and more particularly either by way of a dust-protection sieve 23 or by way of an extended line 24 which is connected to the air intake 14, and by way of the air filter 15.

According to the present invention, the valve 7 according to this invention is now interconnected into the line 22. A valve connection 25 which is provided in addition to the connections for the air line 22, is connected by way of the line 26 with the suction pipe 11 in which prevails the vacuum.

In the drawing, the installation is illustrated in the idling position in solid line. The throttle valve 12 is closed. The exhaust brake valve 9 is in an open position. The valve 7 according to the present invention connects the vented side 21 of the output stage 17 of the gas regulator and of the diaphragm 18 with the atmosphere by way of the dust-protection sieve 23 or of the air filter 15. If now one shifts to braking by means of the exhaust brake, i.e., the engine exhaust brake is engaged, then the actuating member 1 is reversed or shifted. This shifting of the actuating member 1 brings about the shifting of the shifting valve 5 which closes the exhaust brake valve 9 (phantom line) and the shifting of the shifting valve 6 which opens the throttle valve 12 (phantom line), and the shifting of the valve 7 according to the present invention which connects the air line 22 with the suction pipe 11 by way of the line 26. The flap or control valve 19 is now closed by the vacuum now acting on the diaphragm 18 from one side thereof and therewith the gas supply by way of the gas line 16 to the gas air-mixer 13 is interrupted.

The gas quantity may also be controlled by way of two or several governors or gas regulators of conventional construction operating in parallel with one another, which act on a common gas mixer. The vent lines of the gas regulators are then interconnected so that the vacuum control is realized by means of a single valve.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

What I claim is:

1. An engine exhaust brake for a motor vehicle operated by a gas engine, which upon its engagement causes the closing of an exhaust gas line with the aid of an exhaust brake valve means and the opening of a throttle valve controlling the mixture supply, a gas-air mixer means arranged upstream of the throttle valve, and a diaphragm controlled gas regulator means including an output stage having a vented side operatively connected with the atmosphere by way of an air line, the gas supply of the gas-air mixer means being controlled by said output stage, characterized in that a control valve means is connected in said air line which is controllable by engagement of the engine brake and which upon engagement of the engine brake is operable to connect the vented side of the output stage of the gas regulator means with a vacuum source whose vacuum causes the closing of the gas supply to the gas-air mixer means.

2. An engine brake according to claim 1, characterized in that the vacuum source is the engine suction pipe.

3. An engine brake according to claim 2, characterized in that the vented side of the gas regulator means is connected with the atmosphere by way of a filtering protection means.

4. An engine brake according to claim 3, characterized in that the filtering protection means is formed by an air filter arranged upstream of the gas-air mixer means and the air line is operatively connected with an intake connecting the air filter with the gas-air mixer means.

5. An engine brake according to claim 3, characterized in that the filtering protection means is constituted exclusively by a dust-protection sieve means which is mounted on the end of the air line disposed in proximity to the control valve means.

6. An engine brake according to claim 2, characterized in that the control valve means as also the throttle valve and the exhaust brake valve means are controlled hydraulically.

7. An engine brake according to claim 2, characterized in that the control valve means as also the throttle valve and the exhaust brake valve means are controlled pneumatically.

8. An engine brake according to claim 2, characterized by actuating means which actuate the control valve means, the throttle valve and the exhaust brake valve.

9. An engine brake according to claim 8, characterized in that the actuating means are hydraulic actuating means.

10. An engine brake according to claim 8, characterized in that the actuating means are pneumatic actuating means.

11. An engine brake according to claim 8, characterized in that the actuating means actuate the control valve means, the throttle valve and the exhaust brake valve means in unison.

12. An engine brake according to claim 11, characterized in that the actuating means are hydraulic actuating means.

13. An engine brake according to claim 11, characterized in that the actuating means are pneumatic actuating means.

14. An engine brake according to claim 8, characterized in that the actuating means actuate the control valve means, the throttle valve and the exhaust brake valve in combination of two's.

15. An engine brake according to claim 14, characterized in that the actuating means are hydraulic actuating means.

16. An engine brake according to claim 14, characterized in that the actuating means are pneumatic actuating means.

17. An engine brake according to claim 8, characterized in that the actuating means simultaneously actuate the control valve means, the throttle valve and the exhaust brake valve individually.

18. An engine brake according to claim 17, characterized in that the actuating means are hydraulic actuating means.

19. An engine brake according to claim 17, characterized in that the actuating means are pneumatic actuating means.

* * * * *